US010755650B2

(12) United States Patent
Shan

(10) Patent No.: US 10,755,650 B2
(45) Date of Patent: Aug. 25, 2020

(54) DISPLAY DRIVING METHOD AND DISPLAY APPARATUS

(71) Applicant: HKC CORPORATION LIMITED, Shenzhen (CN)

(72) Inventor: Jianfeng Shan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 298 days.

(21) Appl. No.: 15/751,087

(22) PCT Filed: Dec. 8, 2017

(86) PCT No.: PCT/CN2017/115246

§ 371 (c)(1),
(2) Date: Feb. 7, 2018

(87) PCT Pub. No.: WO2019/071779

PCT Pub. Date: Apr. 18, 2019

(65) Prior Publication Data

US 2020/0020285 A1 Jan. 16, 2020

(30) Foreign Application Priority Data

Oct. 10, 2017 (CN) ..... 2017 1 0935848

(51) Int. Cl.
*G09G 3/36* (2006.01)

(52) U.S. Cl.
CPC ..... *G09G 3/3607* (2013.01); *G09G 2310/027* (2013.01); *G09G 2320/028* (2013.01);
(Continued)

(58) Field of Classification Search
CPC ..... G09G 3/3607; G09G 2320/0686; G09G 2320/0666; G09G 2320/028; G09G 2310/027; G09G 3/3685
See application file for complete search history.

(56) References Cited

U.S. PATENT DOCUMENTS 8,570,351 B2 * 10/2013 Mori ..... G09G 3/3607 345/690
9,805,670 B2 * 10/2017 Kang ..... G09G 3/2003
(Continued)

FOREIGN PATENT DOCUMENTS

CN 101345036 A 1/2009
CN 102024403 A 4/2011
(Continued)

OTHER PUBLICATIONS

Shan, International Application No. PCT/CN2017/116323, filed on Dec. 15, 2017 and English Translation thereof.
(Continued)

*Primary Examiner* — Carolyn R Edwards
(74) *Attorney, Agent, or Firm* — Kagan Binder, PLLC

(57) ABSTRACT

The present disclosure provides a display driving method. The display driving method includes: acquiring an original light source intensity of each of hues of a content to be displayed in a preset display area; setting a driving light source intensity in the display area to be three times of the original light source intensity; acquiring an original gray scale data group of each of pixel units of the content to be displayed in the preset display area; and dividing the original gray scale data group into a first gray scale data group, a second gray scale data group, and a third gray scale data group according to the original gray scale data group of each of the pixel units.

20 Claims, 5 Drawing Sheets

(52) U.S. Cl.
CPC ..... *G09G 2320/0666* (2013.01); *G09G 2320/0686* (2013.01)

(56) References Cited

U.S. PATENT DOCUMENTS

| | | | | |
|---|---|---|---|---|
| 2003/0107681 | A1* | 6/2003 | Otawara | G09G 3/2007 348/673 |
| 2006/0097971 | A1* | 5/2006 | Lee | G09G 3/3648 345/89 |
| 2010/0103206 | A1* | 4/2010 | Kamada | G09G 3/3607 345/690 |
| 2010/0123401 | A1* | 5/2010 | Park | H05B 45/37 315/153 |
| 2012/0206502 | A1* | 8/2012 | Jung | G09G 3/342 345/690 |
| 2013/0229430 | A1* | 9/2013 | Chen | G09G 3/36 345/600 |
| 2017/0053596 | A1* | 2/2017 | Hyun | G09G 3/3233 |
| 2018/0144676 | A1* | 5/2018 | Nadershahi | G09G 3/2055 |
| 2020/0013351 | A1* | 1/2020 | Shan | G09G 3/342 |
| 2020/0020286 | A1* | 1/2020 | Shan | G09G 3/3607 |
| 2020/0020287 | A1* | 1/2020 | Shan | G09G 3/3426 |

FOREIGN PATENT DOCUMENTS

| | | | |
|---|---|---|---|
| CN | 102136255 | A | 7/2011 |
| CN | 103258507 | A | 8/2013 |
| CN | 106873205 | A | 6/2017 |
| CN | 107799079 | A | 3/2018 |

OTHER PUBLICATIONS

Shan, International Application No. PCT/CN2017/115264, filed on Dec. 8, 2017 and English Translation thereof.
Shan, International Application No. PCT/CN2017/115165, filed on Dec. 8, 2017 and English Translation thereof.
Shan, International Application No. PCT/CN2017/115289, filed on Dec. 8, 2017 and English Translation thereof.
Unpublished Utility U.S. Appl. No. 15/750,672, filed Feb. 6, 2018 (Not attached).
International Search Report, and English Translation thereof, for International Application No. PCT/CN2017/115246, dated Jun. 28, 2018, (2 pages).
Chinese Office Action for Chinese Application No. 201710935848.7, dated Mar. 26, 2019 (6 pages).

* cited by examiner

DISPLAY DRIVING METHOD AND DISPLAY APPARATUS

CROSS REFERENCE TO RELATED APPLICATION

This application claims priority to Chinese Patent Application No. 201710935848.7, entitled "DRIVING METHOD, APPARATUS AND DEVICE FOR LIQUID CRYSTAL DISPLAY" filed Oct. 10, 2017, the contents of which is expressly incorporated by reference herein in its entirety.

FIELD OF THE INVENTION

The present invention relates to the technology field of liquid crystal display (LCD), and particularly relates to a display driving method and a display apparatus.

BACKGROUND OF THE INVENTION

With the development of science and technology, liquid crystal television, liquid crystal displayer and various other liquid crystal display devices are increasingly popular and are commonly equipped for residences, malls, office buildings and other places that require information displaying, so as to facilitate the production of life of people.

However, in the color cast change of the side view and front view of various representative color schemes of a prior liquid crystal displayer, the side view color cast of schemes of red, green and blue is more serious over other color schemes, also, due to the fast saturation and escalation of the view angle brightness proportion of gray scale LCD, the front view brightness and side view brightness difference is greater as the gray scale is lower.

SUMMARY

Accordingly, it is necessary to provide a display driving method and display apparatus that can address the problem of the side view color cast.

A display driving method includes:

acquiring an original light source intensity of each of hues of a content to be displayed in a preset display area;

setting a driving light source intensity in the display area to be three times of the original light source intensity;

acquiring an original gray scale data group of each of pixel units of the content to be displayed in the preset display area; and dividing the original gray scale data group into a first gray scale data group, a second gray scale data group, and a third gray scale data group according to the original gray scale data group of each of the pixel units; a gray scale of each of the hues is the minimal gray scale in the first gray scale data group, a gray scale of each of the hues of the second gray scale data group is a gray scale difference or a common gray scale of the gray scale differences, the third gray scale data group is a difference between the original gray scale data group and a gray scale sum; wherein the gray scale difference is a difference of the gray scales of the hues between the original gray scale data group and the first gray scale data group, and the gray scale sum is a sum of the gray scales of the hues in the first gray scale data group and the second gray scale data group.

A display apparatus includes a memory, a processor and a computer program stored on the memory and executable on the processor, the processor executes the computer program to provide steps of the aforementioned display driving method.

A display driving method includes:

acquiring original light source intensity of each hue of a content to be displayed in a preset display area by table look-up;

setting a driving light source intensity in the display area to be three times of the original light source intensity;

acquiring an original gray scale data group of each of pixel units of the content to be displayed in the preset display area;

determining an average gray scale in the preset display area according to the original gray scale data group;

acquiring an average hue and saturation of the preset display area;

upon determining that the second gray scale data group or the third gray scale data group is displayed according to the average hue, the saturation, and the average gray scale, setting the driving light source intensity of a preset hue in the preset display area to be 0; and dividing the original gray scale data group into a first gray scale data group, a second gray scale data group, and a third gray scale data group according to the original gray scale data group of each of the pixel units; wherein a gray scale of each of the hues is the minimal gray scale in the first gray scale data group, a gray scale of each of the hues of the second gray scale data group is a gray scale difference or a common gray scale of the gray scale differences, the third gray scale data group is a difference between the original gray scale data group and a gray scale sum; wherein the gray scale difference is a difference of the gray scales of the hues between the original gray scale data group and the first gray scale data group, and the gray scale sum is a sum of the gray scales of the hues in the first gray scale data group and the second gray scale data group.

According to the display driving method and display apparatus, by dividing the original gray scale data group into a first gray scale data group, a second gray scale data group and a third gray scale data group, i.e., taking the original picture frame signals corresponding to each pixel unit as a multi picture frame combination. And the gray scale of each hue in the first gray scale data group is the minimal gray scale, the gray scale of each hue of the second gray scale data group is the gray scale difference or the common gray scale of the gray scale differences, the third gray scale data group is the difference between the original gray scale data group and a gray scale sum; the gray scale difference is the difference of the gray scale of the hues between the original gray scale data group and the first gray scale data group, and the gray scale sum is the sum of the gray scale of the hues in the first gray scale data group and the second gray scale data group. As such, in order to highlight the major color and to ameliorate the color cast, the gray scale of the hues corresponding to the maximal gray scale in the original gray scale data group is divided into three gray scale data groups less than the maximal gray scale, such that the side view combination brightness of the three gray scale data groups that are less than the maximal gray scale is improved in relation to the original maximal gray scale, the ratio of the viewing angle maximal gray scale major color to the minimal gray scale non-major color brightness is highlighted, so as to reduce the brightness difference of the low gray scale side view sub-pixel hue over the overall pixel hue, such that the side view hue is close to the front view hue presentation.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

Figure 1:
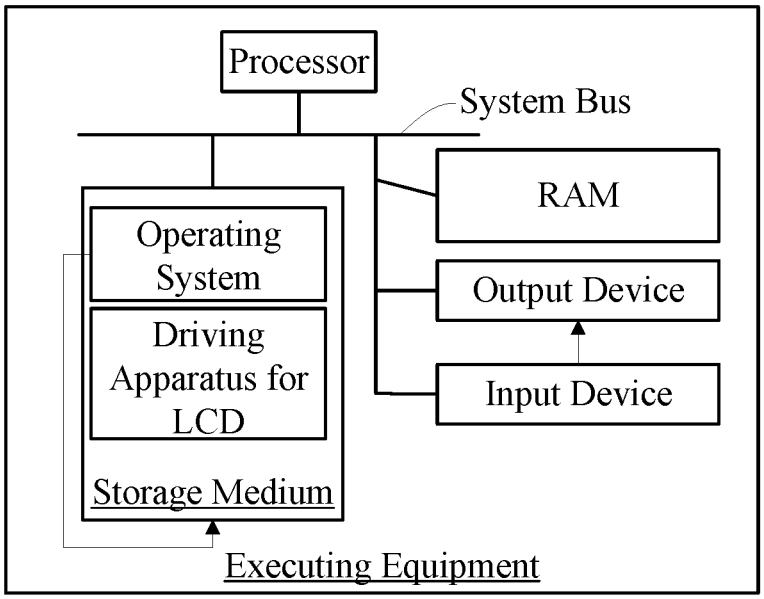
FIG. 1 is a block diagram of an executing device of a display driving method according to an embodiment.

The present disclosure will be described in the following with reference to the accompanying drawings and the embodiments. Particular embodiments are provided in the drawings. The various embodiments of the disclosure may, however, be embodied in many different forms and should not be construed as limited to the specific embodiments set forth hereinafter. Numerous specific details are described hereinafter in order to facilitate a thorough understanding of the present disclosure.

Unless otherwise defined, the technical and scientific terms used herein have the same meaning to the understanding of a person skilled in the art where the present disclosure pertains. The terms used in the specification of the present disclosure is for the purpose of describing the embodiments of the present disclosure, as opposed to limiting thereto. The language "and/or" used in the disclosure refers to any and all combinations of the one or multiple items listed.

FIG. 1 is a block diagram of an executing device according to an embodiment. The executing device can be a terminal that implements the display driving method. The executing device includes a processor, a storage medium, a Random Access Memory (RAM), an output device and, an input device connected through the system bus. An operating system and an computer application program of a liquid crystal display driving apparatus are stored in the storage medium. When the computer application program of the liquid crystal display driving apparatus is executed by the processor, a display driving method is implemented. The processor is configured to provide computation and control capability to support the operation of the executing device. The RAM provides an environment to the computer application program of the liquid crystal display driving apparatus in the storage medium, the internal storage device has stored computer-readable instructions that, when executed by at least one processors, cause the at least one processor to perform a display driving method. The output device of the executing apparatus can be a display screen, the display screen can be an LCD. The input device can be a touch layer covered on the display screen, a button, a trackball or a touch pad configured on the shell of an electronic device, or an external keyboard, touch pad or mouse and so on. A person skilled in the art should understand, FIG. 1 is exemplary to show the structure of the terminal in accordance with an embodiment of the present disclosure and does not limit the executing apparatus to this embodiment; in other embodiments, compared with the structure shown in FIG. 1, the particular terminal may include more or less components, be configured with other components not shown in FIG. 1, or have a different configuration.

Figure 2:
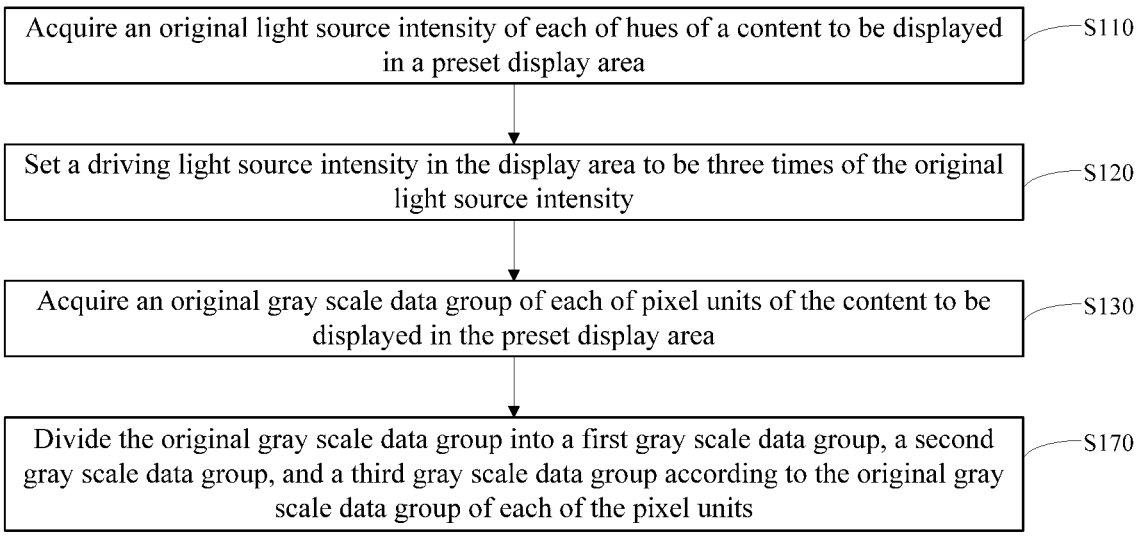
FIG. 2 is a flowchart of a display driving method according to an embodiment.

Referring to FIG. 2, a display driving method is provided, which includes:

In S110: original light source intensities of each hue of a content to be displayed in a preset display area are acquired.

By table look-up, original light source intensities of each of the hues of the content to be displayed in the preset display area are acquired, i.e., the original light source intensity group in the preset display area and of the content to be displayed are acquired. It should be understood that, the table can be pre-stored in the storage device and be called when it is required. The table can also be obtained when it is required, thereby obtaining the original light source intensity group in the preset display area and of the content to be displayed. The light source intensity group of the content to be displayed at column n and row m in the display area can be represented as ($A_{n,\ m_R}$, $A_{n,\ m_G}$, $A_{n,\ m_B}$,).

In S120: a driving light source intensity in the display area is set up to be three times of the original light source intensity.

In the present embodiment, the original gray scale data group of each pixel unit in the preset display area is required to be divided into three gray scale data sub-groups, thus, the driving light source intensity in the preset area is required to be set to three times of the original light source intensity, so as to compensate the lowered brightness due to the gray scale division. The original light source intensities of each hue of R, G, B in the preset display area (n, m) are $A_{n,\ m_R}$, $A_{n,\ m_G}$, $A_{n,\ m_B}$, which will be adjusted to driving light source intensity $A'_{n,\ m_R}$, $A'_{n,\ m_G}$, $A'_{n,\ m_B}$, of those, $A'_{n,\ m_R}=3*A'_{n,\ m_R}$, $A'_{n,\ m_G}=3*A'n,\ m_G$, $A'_{n,\ m_B}=3*A'_{n,\ m_B}$.

In S130: an original gray scale data group of each pixel unit of the content to be displayed in the preset display area is acquired.

The LCD is composed with a plurality of RGB sub-pixel units, each group of RGB sub-pixels is called a pixel unit, each of which represents an image signal. The original gray scale data group of all pixel unit includes gray scales of three hues of R, G, B, for example, ($R_{n,m_i,j}$, $G_{n,m_i,j}$, $B_{n,m_i,j}$) can represent the original gray scale data group of the pixel unit at column i row j in the display area at column n row m. The display region of the LCD can be divided into several display areas, each of which includes at least two pixel units, the size of the display area is customizable, the LCD can be divided into N (columns)*M (rows) display sections composed by pixel units. Various display areas can serve as the preset display areas according to a preset sequence, so as to implement the display driving method.

In S170: the original gray scale data group is divided into a first gray scale data group, a second gray scale data group, and a third gray scale data group according to the gray scale data group of each pixel unit. The gray scale of each hue in the first gray scale data group is the minimal gray scale, the gray scale of each hue of the second gray scale data group is the gray scale differences or the common gray scales of the gray scale differences, the third gray scale data group is the difference between the original gray scale data group and a gray scale sum; the gray scale difference is the difference of the gray scale of the hues between the original gray scale data group and the first gray scale data group, and the gray scale sum is the sum of the gray scale of the hues in the first gray scale data group and the second gray scale data group.

According to the display driving method, the original gray scale data group is divided into the first gray scale data group, the second gray scale data group and the third gray scale data group, i.e., taking the original picture frame signals corresponding to each pixel unit as a multi picture frame combination. And the gray scale of each hue in the first gray scale data group is the minimal gray scale, the gray scale of each hue of the second gray scale data group is the gray scale differences or the common gray scales of the gray scale differences, the third gray scale data group is the difference between the original gray scale data group and a gray scale sum; the gray scale difference is the difference of the gray scale of the hues between the original gray scale data group and the first gray scale data group, and the gray scale sum is the sum of the gray scale of the hues in the first gray scale data group and the second gray scale data group. As such, in order to highlight the major color and to ameliorate the color cast, the gray scale of the hues corresponding to the maximal gray scale in the original gray scale data group is divided into three gray scale data groups less than the maximal gray scale, such that the side view combination brightness of the three gray scale data groups that are less than the maximal gray scale is improved with respect to the viewing angle brightness of the original maximal gray scale, the ratio of the viewing angle maximal gray scale major color to the minimal gray scale non-major color brightness is highlighted, so as to reduce the brightness difference of the low gray scale side view sub-pixel hue with respect to the overall pixel hue, such that the side view hue is presented close to the front view hue.

Figure 3:
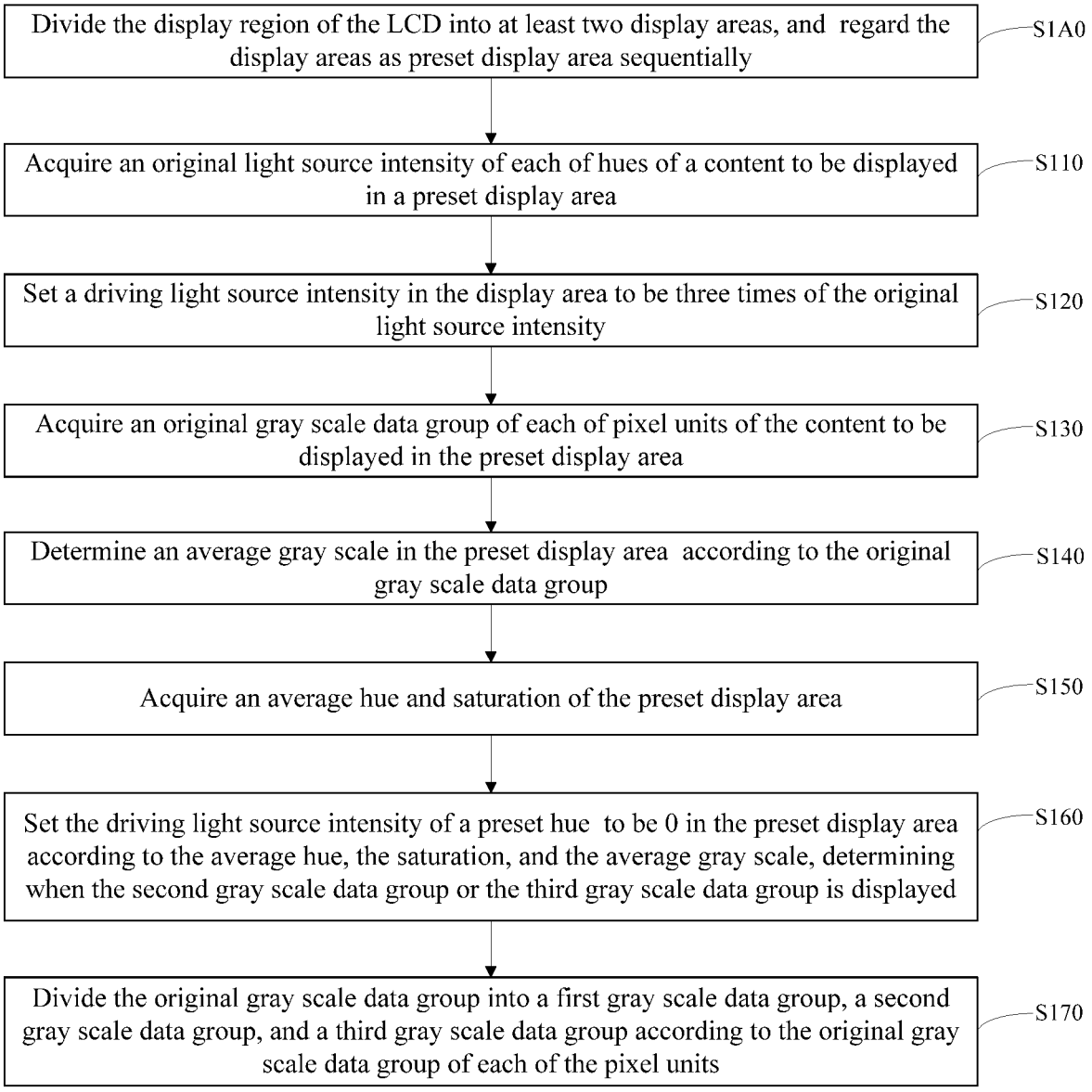
FIG. 3 is a flowchart of a display driving method according to an embodiment.

Referring to FIG. 3, in an embodiment, before the original gray scale data group is divided into a first gray scale data group, a second gray scale data group and a third gray scale data group, i.e., before step S170, the method further includes:

In S140: an average gray scale in the preset display area is determined according to the original gray scale data group.

An average gray scale of each hue in the preset display area can be determined according to the original gray scale data groups of each pixel unit in the preset display area. By respectively summing up each hue of the original gray scale data groups in each pixel unit and then dividing by the number of pixel units in the preset display area, the average gray scale of each hue in the preset display area is obtained, which is the average gray scale group in the preset display area. For example, ($Ave_R_{n,m}$, $Ave_G_{n,m}$, $Ave_B_{n,m}$) can be used to represent the average gray scale group of the display area at column n and row m.

In S150: an average hue and saturation of the preset display area are acquired.

The average hue and saturation of the preset display area can be acquired according to the average gray scale in the preset display area by using a color space system to determine the average hue and saturation of the preset display area. The color space system can be a CIE LCH color space system, where CIE LCH is a R, G, B tricolor space coordinate system proposed by CIE (Commission Internationale de L'Eclairage,). The coordinate system includes L (brightness), C (purity), and H (hue), which can be determined by coordinate functions of the CIE standard. The coordinate functions can be respectively expressed as L=f1(R, G, B), C=f1(R, G, B), H=f1(R, G, B). H is a color representative, using 0° to 360° to represent the color rendering of different hues, where 0° is defined as red, 90° is defined as yellow, 180° is defined as green, 270° is defined as blue, C is the color chroma representing the brightness degree of color, a range of C is from 0 to 100, 100 represents the most bright color, and to some extent a value of C is rendering of the LCD displaying the high and low voltage signals.

In S160, the driving light source intensity of a preset hue in the preset display area is set to be 0, on determining that the second gray scale data group or the third gray scale data group is displayed according to the average hue, the saturation, and the average gray scale, which specifically includes methods as follows;

According to an embodiment, when the average hue $H_{n,m}$ of the preset display area satisfies a range from 330° to 30°, and saturation is in a first custom saturation range from CTL1 to CTH1, if the hue corresponding to a minimal gray scale in the average gray scales is green, and the hue corresponding to a second minimal gray scale in the average gray scales is green, then the preset hue is blue when the second gray scale data group is displayed, i.e., upon determining that the second gray scale data group is displayed, the driving light source intensities of blue hues in the preset display area are set to be 0; when the third gray scale data group is displayed, the preset hue is blue and green, i.e., upon determining that the third gray scale data group is displayed, the driving light source intensities of the blue hues and green hues in the preset display area are set to be 0.

The hue corresponding to the minimal gray scale of the average gray scales is green, and the hue corresponding to the second minimal gray scale is green. Therefore, $Ave_R_{n,m}=A>Ave_G_{n,m}=B>Ave_B_{n,m}=C$ within the preset display area. Even if the situation that the other pixel units of $R_{i,j}$, $G_{i,j}$, $B_{i,j}$ do not satisfy $R_{i,j}>G_{i,j}>B_{i,j}$, exists in the preset display area, i.e., the original gray scale data group does not meet $R_{i,j}>G_{i,j}>B_{i,j}$, since the average gray scale $Ave_R_{n,m}=A>Ave_G_{n,m}=B>Ave_B_{n,m}=C$ in the preset display area are mainly and the main display color is red, most of pixel units are covered by red, few pixel units exit in the B hues present in the second and third gray scale data group, and B hues are not displayed due to the intensity of the driving light source thereof is 0, which will not which will not affect the overall picture quality too much.

At the same time, since the dominant display color of the average primary gray scale in the preset display area is saturated red, the gray scales of the G and B hues are equivalent, which are rather small in comparison to the gray scale of R hues, it can be predicted that in the few presenting third gray scale data group, if the driving light source intensity of the G hues is 0, a few gray scales of the G hues of the third gray scale data group will not be displayed, which will not affect the overall picture quality too much.

Accordingly, the driving light source intensities of preset hues in the preset display area are set to be 0, when the second and third gray scale data group are displayed, i.e., the driving light source of the preset hues is turned off, whereby the benefits of saving energy without affecting the overall picture quality can be achieved.

Likewise, when the second and third gray scale data groups are displayed in the following manner, the driving light source intensities of the preset hues in the preset display area are set to be 0, whereby the benefits of saving energy without affecting the overall picture quality can be achieved.

According to an embodiment, when the average hue $H_{n,m}$ of the preset display area satisfies a range from 330° to 30°, and the saturation is in a first custom saturation range from CTL1 to CTH1, if the hue corresponding to a minimal gray scale in the average gray scales is green, and the hue corresponding to a second minimal gray scale in the average gray scales is blue, then the preset hue is green when the second gray scale data group is displayed, i.e., upon determining that the second gray scale data group is displayed, the driving light source intensities of green hues in the preset display area are set to be 0; when the third gray scale data group is displayed, the preset hue is blue and green, i.e., upon determining that the third gray scale data group is displayed, the driving light source intensities of the blue hues and green hues in the preset display area are set to be 0.

According to an embodiment, when the average hue $H_{n,m}$ of the preset display area satisfies a range from 30° to 90°, and the saturation is in a second custom saturation range from CTL2 to CTH2, if the hue corresponding to a minimal gray scale in the average gray scales is blue, and the hue corresponding to a second minimal gray scale in the average gray scales is green, then the preset hue is blue when the second gray scale data group is displayed, i.e., upon determining that the second gray scale data group is displayed, the driving light source intensities of blue hues in the preset display area are set to be 0; when the third gray scale data group is displayed, the preset hue is blue and green, i.e., upon determining that the third gray scale data group is displayed, the driving light source intensities of the blue hues and green hues in the preset display area are set to be 0.

According to an embodiment, when the average hue $H_{n,m}$ of the preset display area satisfies a range from 90° to 150°, and the saturation is in a third custom saturation range from CTL3 to CTH3, if the hue corresponding to a minimal gray scale in the average gray scales is green, and the hue corresponding to a second minimal gray scale in the average gray scales is red, then the preset hue is blue when the second gray scale data group is displayed, i.e., upon determining that the second gray scale data group is displayed, the driving light source intensities of blue hues in the preset display area are set to be 0; when the third gray scale data group is displayed, the preset hue is blue and red, i.e., upon determining that the third gray scale data group is displayed, the driving light source intensities of the blue hues and red hues in the preset display area are set to be 0.

According to an embodiment, when the average hue $H_{n,m}$ of the preset display area satisfies a range from 150° to 210°, and the saturation is in a fourth custom saturation range from CTL4 to CTH4, if the hue corresponding to a minimal gray scale in the average gray scales is green, and the hue corresponding to a second minimal gray scale in the average gray scales is red, then the preset hue is blue when the second gray scale data group is displayed, i.e., upon determining that the second gray scale data group is displayed, the driving light source intensities of blue hues in the preset display area are set to be 0; when the third gray scale data group is displayed, the preset hue is blue and red, i.e., upon determining that the third gray scale data group is displayed, the driving light source intensities of the blue hues and red hues in the preset display area are set to be 0.

According to an embodiment, when the average hue $H_{n,m}$ of the preset display area satisfies a range from 150° to 210°, and the saturation is in a fourth custom saturation range from CTL4 to CTH4, if the hue corresponding to a minimal gray scale in the average gray scales is red, and the hue corresponding to a second minimal gray scale in the average gray scales is green, then the preset hue is red when the second gray scale data group is displayed, i.e., upon determining that the second gray scale data group is displayed, the driving light source intensities of red hues in the preset display area are set to be 0; when the third gray scale data group is displayed, the preset hue is blue and red, i.e., upon determining that the third gray scale data group is displayed, the driving light source intensities of the blue hues and red hues in the preset display area are set to be 0.

According to an embodiment, when the average hue $H_{n,m}$ of the preset display area satisfies a range from 210° to 240°, and the saturation is in a fifth custom saturation range from CTL5 to CTH5, if the hue corresponding to a minimal gray scale in the average gray scales is red, and the hue corresponding to a second minimal gray scale in the average gray scales is green, then the preset hue is red when the second gray scale data group is displayed, i.e., upon determining that the second gray scale data group is displayed, the driving light source intensities of red hues in the preset display area are set to be 0; when the third gray scale data group is displayed, the preset hue is blue and red, i.e., upon determining that the third gray scale data group is displayed, the driving light source intensities of the blue hues and red hues in the preset display area are set to be 0.

According to an embodiment, when the average hue $H_{n,m}$ of the preset display area satisfies a range from 210° to 240°, and the saturation is in a fifth custom saturation range from CTL5 to CTH5, if the hue corresponding to a minimal gray scale in the average gray scales is red, and the hue corresponding to a second minimal gray scale in the average gray scales is green, then the preset hue is red when the second gray scale data group is displayed, i.e., upon determining that the second gray scale data group is displayed, the driving light source intensities of red hues in the preset display area are set to be 0; when the third gray scale data group is displayed, the preset hue is green and red, i.e., upon determining that the third gray scale data group is displayed, the driving light source intensities of the green hues and red hues in the preset display area are set to be 0.

According to an embodiment, when the average hue $H_{n,m}$ of the preset display area satisfies a range from 240° to 300°, and the saturation is in a sixth custom saturation range from CTL6 to CTH6, if the hue corresponding to a minimal gray scale in the average gray scales is red, and the hue corresponding to a second minimal gray scale in the average gray scales is green, then the preset hue is red when the second gray scale data group is displayed, i.e., upon determining that the second gray scale data group is displayed, the driving light source intensities of red hues in the preset display area are set to be 0; when the third gray scale data group is displayed, the preset hue is green and red, i.e., upon determining that the third gray scale data group is displayed, the driving light source intensities of the green hues and red hues in the preset display area are set to be 0.

According to an embodiment, when the average hue $H_{n,m}$ of the preset display area satisfies a range from 240° to 300°, and the saturation is in a sixth custom saturation range from CTL6 to CTH6, if the hue corresponding to a minimal gray scale in the average gray scales is green, and the hue corresponding to a second minimal gray scale in the average gray scales is red, then the preset hue is green when the second gray scale data group is displayed, i.e., upon determining that the second gray scale data group is displayed, the driving light source intensities of green hues in the preset display area are set to be 0; when the third gray scale data group is displayed, the preset hue is green and red, i.e., upon determining that the third gray scale data group is displayed, the driving light source intensities of the green hues and red hues in the preset display area are set to be 0.

According to an embodiment, when the average hue $H_{n,m}$ of the preset display area satisfies a range from 300° to 330°, and the saturation is in a seventh custom saturation range from CTL7 to CTH7, if the hue corresponding to a minimal gray scale in the average gray scales is green, and the hue corresponding to a second minimal gray scale in the average gray scales is red, then the preset hue is green when the second gray scale data group is displayed, i.e., upon determining that the second gray scale data group is displayed, the driving light source intensities of green hues in the preset display area are set to be 0; when the third gray scale data group is displayed, the preset hue is green and red, i.e., upon determining that the third gray scale data group is displayed, the driving light source intensities of the green hues and red hues in the preset display area are set to be 0.

According to an embodiment, when the average hue $H_{n,m}$ of the preset display area satisfies a range from 300° to 330°, and the saturation is in a seventh custom saturation range from CTL7 to CTH7, if the hue corresponding to a minimal gray scale in the average gray scales is green, and the hue corresponding to a second minimal gray scale in the average gray scales is green, then the preset hue is green when the second gray scale data group is displayed, i.e., upon determining that the second gray scale data group is displayed, the driving light source intensities of green hues in the preset display area are set to be 0; when the third gray scale data group is displayed, the preset hue is green and red, i.e., upon determining that the third gray scale data group is displayed, the driving light source intensities of the green hues and blue hues in the preset display area are set to be 0.

In a specific example, as there are two embodiments as follow and of the pixel units in the preset display area, it is therefore required to, according to the foregoing embodiment, set the driving light source intensity of the preset hue in the preset display area to be 0, upon determining that the second gray scale data group or the third gray scale data group is displayed.

Example One

The average gray scales of each hue in a preset display area are: $Ave_R_{n,m}=A$, $Ave_G_{n,m}=B$ and $Ave_B_{n,m}=C$, respectively, where A>B>C, which belongs to a red hue combination. When there are pixel units having different sizes and sequences from the average gray scales in the preset display area, such as the gray scales of each hue in the original gray scale data groups of a pixel unit are $R_{i,j}=A2$, $G_{i,j}=B2$, $B_{i,j}=C2$, it is a green hue combination that B2>C2>A2. When the original gray scale data group is divided into three gray scale data group, which are the first gray scale data group ($R1_{i,j}$, $G1_{i,j}$, $B1_{i,j}$), the second gray scale data group ($R2_{i,j}$, $G2_{i,j}$, $B2_{i,j}$), and the third gray scale data group ($R3_{i,j}$, $G3_{i,j}$, $B3_{i,j}$). The first, second, and third gray scale data groups satisfy that $R1_{i,j}+R2_{i,j}+R3_{i,j}=R_{i,j}$, $G1_{i,j}+G2_{i,j}+G3_{i,j}=G_{i,j}$ and $B1_{i,j}+B2_{i,j}+B3_{i,j}=B_{i,j}$. $R1_{i,j}$, $G1_{i,j}$ and $B1_{i,j}$ are all minimal gray scales $R_{i,j}$ that adopt the pixel unit original gray scale data group, i.e., $R1_{i,j}=A2$, $G1_{i,j}=A2$ and $B1_{i,j}=A2$. The gray scales of the each hue of the second gray scale data group are the gray scale differences or the common gray scales of the gray scale differences between the original gray scale data group ($R_{i,j}$, $G_{i,j}$, $B_{i,j}$) and the first gray scale data group ($R1_{i,j}=A2$, $G1_{i,j}=A2$, $B1_{i,j}=A2$). It should be noted that when the gray scale difference is 0, the gray scale of the hue is 0; when the gray scale difference is not 0, the gray scale of the hue is a common gray scale of the gray scale difference that is not 0; the common gray scale is a shared portion of two gray scale differences, i.e., equivalent to the relatively smaller one among various non-zero gray scale differences. That is $R2_{i,j}=0$, $G2_{i,j}=C2-A2$ and $B2_{i,j}=C2-A2$. The third gray scale data group are the differences between the original gray scale data group and the gray scale data sum, that is $R2_{i,j}=0$, $G2_{i,j}=C2-A2$ and $B2_{i,j}=C2-A2$.

Example Two

Assuming that the average gray scales of each hue in a preset display area are: $Ave_R_{n,m}=A$, $Ave_G_{n,m}=B$ and $Ave_B_{n,m}=C$, the preset display area is a red hue combination where A>B>C. As such, most of the pixel units in the preset display area satisfy that $R_{i,j}>G_{i,j}>B_{i,j}$. For example, an original data group corresponding to a pixel unit is ($R_{i,j}=A1$, $G_{i,j}=B1$, $B_{i,j}=C1$), where A1>B1>C1, the minimal gray scale in the original gray scale data group is C1, thus the gray scales of each hue of the divided first gray scale pixel group are C1; the gray scales of the blue hues in the second gray scale data group are 0. Therefore, when displaying the second gray scale data group, the driving light source intensities of the blue hues in the preset display area are set to be 0, for example, the LED light source of the B hue can be turned off when displaying the second gray scale data group, such that the energy is saved.

Although there are relatively few pixel units in the preset display area that does not satisfy $R_{i,j}>G_{i,j}>B_{i,j}$, there must still be a few pixel units with condition 1 where $R_{i,j}=A2$, $G_{i,j}=B2$, $B_{i,j}=C2$, where B2>C2>A2. In such a case, the $B2_{i,j}=C2-A2$ gray scales in the second gray scale data group cannot be normally represented. Likewise, when the third gray scale data group is to be displayed, the driving light source intensities of G, B hues are set to be 0, for example, the LED light source of G, B hues are turned off, such that when the size and sequence of the pixel units in the preset display area is different from that of the average gray scale, the green hue combination in situation 1 where $R_{i,j}=A2$, $G_{i,j}=B2$, $B_{i,j}=C2$ (B2>C2>A2), the $G3_{i,j}=B2-C2$ gray scale of the third gray scale data group cannot be normally presented via the LED light source of G hue.

According to an embodiment, after the original gray scale data group is divided into the first gray scale data group, the second gray scale data group, and the third gray scale data group, the method further includes:

In S180: an original display duration of the original gray scale data group is acquired.

In S190: the first gray scale data group, the second gray scale data group, and the third gray scale data group are continuously displayed within the original display duration.

In the illustrated embodiment, the gray scale data group of the original picture frame corresponding to the first pixel unit is divided into a first gray scale data group, a second gray scale data group and a third gray scale data group of three picture frames (a first picture frame, a second picture frame, and a third picture frame) corresponding to the pixel unit. The combination of three picture frames is time-sequentially presented in time, i.e., the first gray scale data group, the second gray scale data group, and the third gray scale data group are displayed sequentially. The original display duration is divided into three time periods, among which the first gray scale data group is displayed in one time period, the second gray scale data group is displayed in another time period, and the third gray scale data group is displayed in a third time period. Preferably, to ensure the display performance, the three time periods are of a same length, i.e., each of which is ⅓ of the original display duration. In the preferable embodiment, it can be implemented by way of increasing the picture frame frequency of the displayer by three times.

In an embodiment, prior to the original gray scale data group of each pixel unit of the content to be displayed and in the preset display area is acquired, and prior to the original light source intensity of each hue of the content to be displayed and in the preset display area, the method further includes:

S1A0: the display region of the LCD is divided into at least two display areas, and the display areas are regarded as preset display area sequentially.

Various display areas can be sequentially arranged as the preset display areas according to a preset sequence, so as to implement the display driving method. The preset sequence can be a sequence where a row sorting is first performed prior to a column sorting, or a sequence where a column sorting is performed prior to a row sorting. As such, liquid crystal display driving is performed to various display areas of the entire LCD, thereby realizing the display driving for the entire LCD.

In an embodiment, the step of dividing the original gray scale data group into the first gray scale data group, the second gray scale data group, and the third gray scale data group according to the original gray scale data group of each pixel unit further includes:

a) the gray scales of each hue in the first gray scale data group are determined according to the minimal gray scale of the original gray scale data group. That is, the minimal gray scale of the original gray scale data group serves as the gray scale of each hue in the first gray scale data group.

b) the gray scales of each hue of the second gray scale data group are determined to be the gray scale differences or the common gray scales of the gray scale differences according to the original gray scale data group and the first gray scale data group; the gray scale differences are the differences of the gray scales of the hues between the original gray scale data group and the first gray scale data group. The common gray scale can be the shared portion of the two gray scale differences, which is equal to the smaller one in the gray scale differences.

c) a third gray scale data group is determined according to the original gray scale data group and the gray scale sum; the gray scale sum is the sum of the gray scales of the hues in the first gray scale data group and the second gray scale data group.

In the illustrated embodiment, the gray scales of each hue of the second gray scale data group are the gray scale differences or the common gray scales of the gray scale differences, as such, the gray scales of the two hues that are not 0 and in the second gray scale data group are prevented to be greater than the minimal gray scale among the average gray scales in the preset display area and affecting the display performance after the division, thereby achieving a preferable effect of reducing the brightness differences of each hue between front view and side view of the low gray scale, and produces a preferable image presentation performance of low color cast display.

As a particular example, when all the gray scales of each hue in the preset display area are red hue combination that $R_{i,j}$=100, $G_{i,j}$=80, $B_{i,j}$=40, the original gray scale data group of the original picture frame corresponding to a pixel unit (i, j) is divided into a first gray scale data group ($R1_{i,j}$, $G1_{i,j}$, $B1_{i,j}$), a second gray scale data group ($R2_{i,j}$, $G2_{i,j}$, $B2_{i,j}$) and a third gray scale data group ($R3_{i,j}$, $G3_{i,j}$, $B3_{i,j}$) of three picture frames (a first picture frame, a second picture frame and a third picture frame) corresponding to the pixel unit. The gray scales of each hue in the first gray scale data group are the minimal gray scale in the original gray scale data group, i.e., 40, which is $R1_{i,j}$=40, $G1_{i,j}$=40, $B1_{i,j}$=40. The gray scales of each hue in the second gray scale data group are the gray scale differences or the common gray scales of the gray scale differences. As the common gray scale of $R_{i,j}$–$R1_{i,j}$=60 and $G_{i,j}$-$G1_{i,j}$=40 is 40, then $R2_{i,j}$=40, $G2_{i,j}$=40, $B2_{i,j}$=0. The gray scales of each hue of the third gray scale data group are the differences between the original gray scale data group and the gray scales sum, i.e., $R3_{i,j}$=20, $G3_{i,j}$=0, $B3_{i,j}$=0. The original gray scale data group is divided into three gray scale data groups, the three gray scale data groups are time-sequentially presented. That is, the original display duration is required to be equally divided into three time periods, where one time period presents the first gray scale data group, another time period presents the second gray scale data group, and a third time period presents the third gray scale data group.

Assuming the brightness ratios of the front view of the original gray scale data group ($R_{i,j}$=100, $G_{i,j}$=80, $B_{i,j}$=40) of a pixel unit to a full gray scale 255 are SR %, LG %, MB %, correspondingly, the side view brightness ratios are SR' %, LG' %, MB' %, where SR>LG>MB and SR'>LG'>MB'. Since the front view and side view brightness ratio difference is greater as the gray scale signal is lower, it can be understood that SR/MB>SR'/MB' and LG/MB>LG'/MB', the color is mixed such that the brightness ratio of the primary brightness signal SR at the front view is greater than that of MB in terms of difference, still, in the case of side view, the brightness ratio of the primary brightness signal SR' is less than that of MB' in terms of difference, the color brightness is reduced as the primary hue color of the front view is affected. In view of the optical-electrical characteristics of prior VA displays, the brightness variation corresponding to a standard signal is a relation conforming to an exponent 2.2. For example, Y=(X/255)2.2, Y is a normalization brightness, X is a gray scale (a preferred gray scale is a 8 bit signal between 0 and 255), by way of a table look-up or that the brightness variation corresponding to the above signal is a relation conforming to the exponent 2.2, it can be determined that SR %=13.3%, LG %=7.4%, MB=1.7%, SR' %=39%, LG' %=34.7%, MB'=23.1%.

As the all gray scales of the first gray scale data group are 40, by way of a table look-up, it can be determined that the front view brightness ratios of each hue of the first picture frame are respectively: 1.8%, 1.8%, 1.8%, and the side view brightness ratios are respectively: 17%, 17%, 17%. As to the second gray scale data group ($R2_{i,j}$=40, $G2_{i,j}$=40, $B2_{i,j}$=0), by way of a table look-up, it can be determined that the front view brightness ratios of each hue of the second picture frame are respectively: 1.8%, 1.8%, 0%, and the side view brightness ratios are respectively: 17%, 17%, 0%. As to the second gray scale data group ($R3_{i,j}$=20, $G3_{i,j}$=0, $B3_{i,j}$=0), by way of a table look-up, it can be determined that the front view brightness ratios of each hue of the third picture frame are respectively: 0.5%, 0%, 0%, and the side view brightness ratios are respectively: 9%, 0%, 0%.

As the composite brightness ratios of the combination of the side view picture frames 1, 2, 3 on each hue $R_{i,j}$, $G_{i,j}$, $B_{i,j}$ are respectively 17%+17%+9%=43%, 17%+17%+0%=34%, 17%+0%+0%=17%, while brightness ratios of each hue of the side view of the original picture frame are respectively 40%, 33%, 17%, accordingly, the main hue, in relation to the ratio of the brightness ratio of B of low gray scale, is increased from 40%/17%=2.35 of the original picture frame to 43%/17%=2.53 of the combined picture frame, such that the side view is relatively close to the presentation of the main hue of the front view. It should be noted that, the main hue is the hue corresponding to the maximal gray scale in the original gray scale data group corresponding to the pixel unit.

Figure 4:
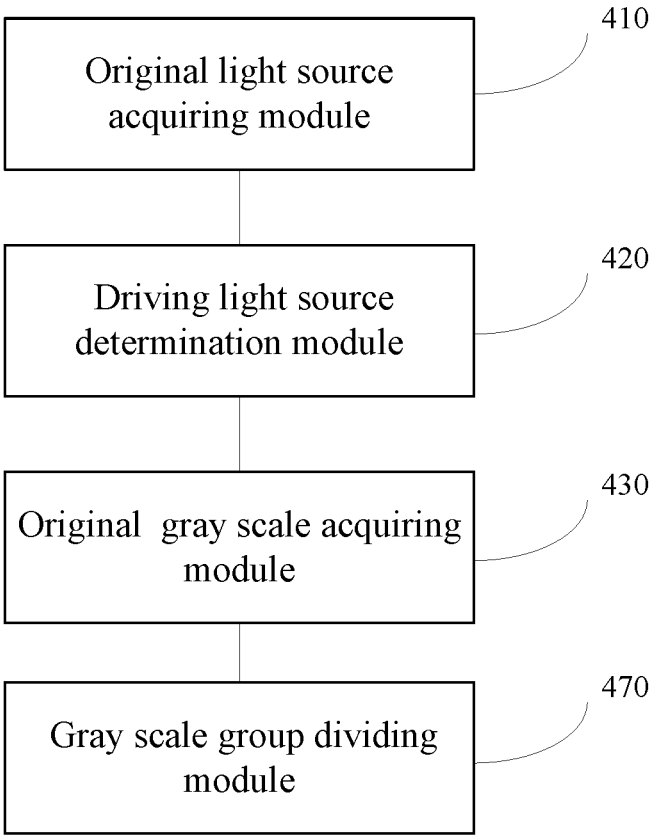
FIG. 4 is a block diagram of a liquid crystal driving device according to an embodiment.

Referring to FIG. 4, an LCD driving apparatus corresponding to foregoing method is also provided herein, which includes:

An original light source acquiring module 410 used to acquire original light source intensities of each hue of a content to be displayed in a preset display area;

A driving light source determination module 420 used to set a driving light source intensity in the display area to be three times of the original light source intensity;

An original gray scale acquiring module 430 used to acquire original gray scale data group of each pixel unit of the content to be displayed in the preset display area;

A gray scale group dividing module 470 use to, according to the gray scale data group of each pixel unit, divide the original gray scale data group into a first gray scale data group, a second gray scale data group and a third gray scale data group; the gray scale of each hue in the first gray scale data group is the minimal gray scale, the gray scale of each hue of the second gray scale data group is the gray scale difference or the common gray scale of the gray scale differences, the third gray scale data group is the difference between the original gray scale data group and a gray scale sum; the gray scale difference is the difference of the gray scale of the hues between the original gray scale data group and the first gray scale data group, and the gray scale sum is the sum of the gray scale of the hues in the first gray scale data group and the second gray scale data group.

According to the driving apparatus for liquid crystal display, by dividing the original gray scale data group into a first gray scale data group, a second gray scale data group and a third gray scale data group, i.e., taking the original picture frame signals corresponding to each pixel unit as a multi picture frame combination. And the gray scale of each hue in the first gray scale data group is the minimal gray scale, the gray scale of each hue of the second gray scale data group is the gray scale difference or the common gray scale of the gray scale differences, the third gray scale data group is the difference between the original gray scale data group and a gray scale sum; the gray scale difference is the difference of the gray scale of the hues between the original gray scale data group and the first gray scale data group, and the gray scale sum is the sum of the gray scale of the hues in the first gray scale data group and the second gray scale data group. As such, in order to highlight the major color and to ameliorate the color cast, the gray scale of the hues corresponding to the maximal gray scale in the original gray scale data group is divided into three gray scale data groups less than the maximal gray scale, such that the side view combination brightness of the three gray scale data groups that are less than the maximal gray scale is improved in relation to the original maximal gray scale, the ratio of the viewing angle maximal gray scale major color to the minimal gray scale non-major color brightness is highlighted, so as to reduce the brightness difference of the low gray scale side view sub-pixel hue over the overall pixel hue, such that the side view hue is close to the front view hue presentation.

Figure 5:
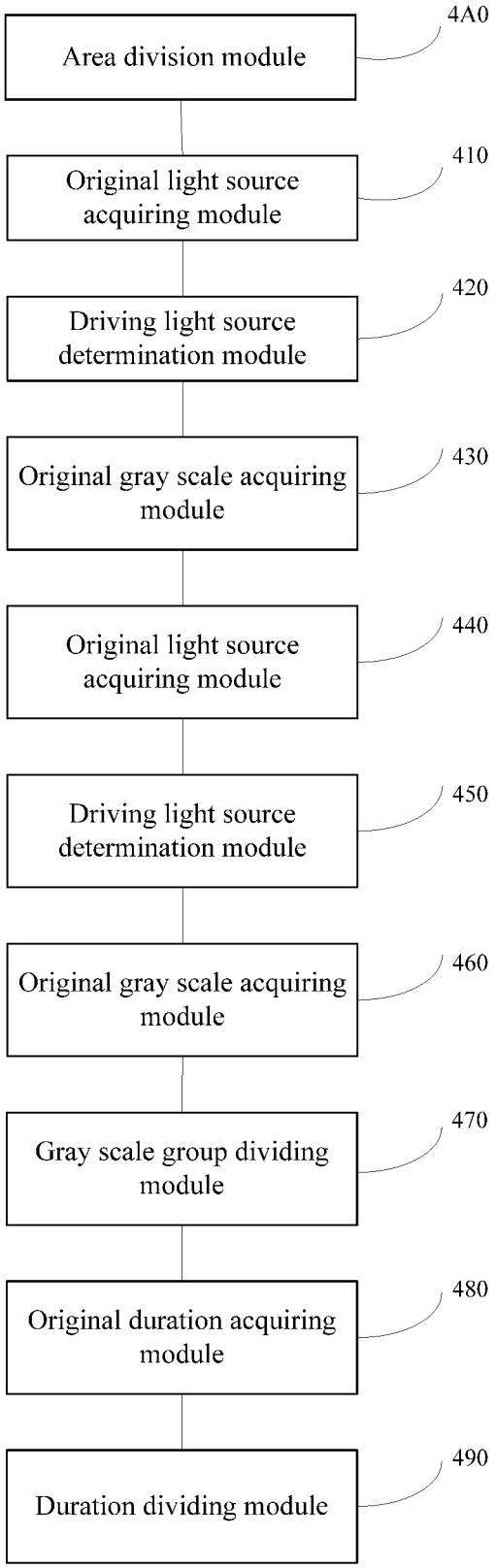
FIG. 5 is a block diagram of a liquid crystal driving device according to another embodiment.

Referring to FIG. 5, in an embodiment, the apparatus further includes:

An average gray scale determination module 440 used to, according to the original gray scale data group, determine an average gray scale in the preset display area;

A hue and saturation acquiring module 450 used to acquire an average hue and saturation of the preset display area;

A light source off determination module 460 used to set the driving light source intensity of a preset hue in the preset display area to be 0, upon determining that the second gray scale data group or the third gray scale data group is displayed according to the average hue, the saturation, and the average gray scale.

Referring to FIG. 5 again, in an embodiment, the apparatus further includes:

An original duration acquiring module 480 configured to acquire an original display duration of the original gray scale data group;

A duration dividing module 490 configured to, within the original display duration, continuously display the first gray scale data group, the second gray scale data group, and the third gray scale data group.

Referring to FIG. 5 again, in an embodiment, further includes:

An area division module 4A0 used to acquire, in the original gray scale acquiring module, the original gray scale data group of each pixel unit of the content to be displayed in the preset display area and to, prior to the original light source intensity of each hue of the content to be displayed in the preset display are is acquired by the original light source acquiring module, divide the display region of the LCD into at least two display areas and sequentially take the display areas as the preset display area.

Figure 6:
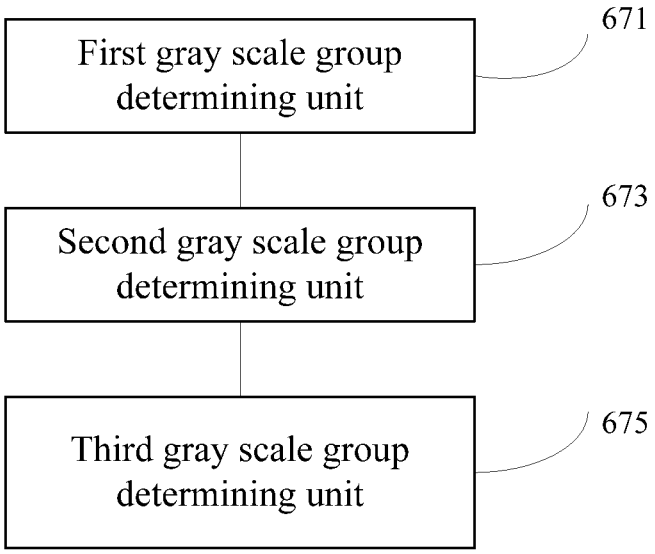
FIG. 6 is a block diagram of a module of a liquid crystal driving device in FIG. 4 or FIG. 5

Referring to FIG. 6, in an embodiment, the gray scale group dividing includes:

A first gray scale group determining unit 671 used to, according to the minimal gray scale of the original gray scale data group, determine the gray scales of each hue in the first gray scale data group;

A second gray scale group determining unit 673 used to, according to the original gray scale data group and the first gray scale data group, determine the gray scales of each hue of the second gray scale data group to be the gray scale differences or the common gray scales of the gray scale differences; the gray scale differences are the differences of the gray scales of the hues between the original gray scale data group and the first gray scale data group;

A third gray scale group determining unit 675 used to, according to the original gray scale data group and the gray scale sum, determine the third gray scale data group; the gray scale sum is the sum of the gray scales of the hues in the first gray scale data group and the second gray scale data group.

A display apparatus corresponding to the foregoing method is also provided.

A display apparatus includes a memory, a processor and a computer program stored on the memory and executable on the processor, the processor executes the computer program to provide steps of the foregoing driving method.

As the foregoing liquid crystal display driving apparatus and liquid crystal display driving method are corresponding to each other, with respect to the specific technical features of the apparatus and corresponding to the foregoing method are omitted for brevity.

As the foregoing display apparatus and display driving method are corresponding to each other, with respect to the specific technical features of the apparatus and corresponding to the foregoing method are omitted for brevity.

It should be noted that, the display apparatus is, for example, an LCD, an Organic Light-Emitting Diode (OLED) display, an Quantum Dot Light Emitting Diodes (QLED), a Curved surface display or other displays.

The different technical features of the above embodiments can have various combinations which are not described for the purpose of brevity. Nevertheless, to the extent the combining of the different technical features do not conflict with each other, all such combinations must be regarded as being within the scope of the disclosure.

The foregoing implementations are merely specific embodiments of the present disclosure, and are not intended to limit the protection scope of the present disclosure. It should be noted that any variation or replacement readily figured out by persons skilled in the art within the technical scope disclosed in the present disclosure shall all fall within the protection scope of the present disclosure. Therefore, the protection scope of the present disclosure shall be subject to the protection scope of the claims.

What is claimed is:

1. A display driving method, comprising:

acquiring an original light source intensity of each of hues of a content to be displayed in a preset display area;

setting a driving light source intensity in the display area to be three times of the original light source intensity;

acquiring an original gray scale data group of each of pixel units of the content to be displayed in the preset display area; and dividing the original gray scale data group into a first gray scale data group, a second gray scale data group, and a third gray scale data group according to the original gray scale data group of each of the pixel units; wherein a gray scale of each of the hues is the minimal gray scale in the first gray scale data group, a gray scale of each of the hues of the second gray scale data group is a gray scale difference or a common gray scale of the gray scale differences, the third gray scale data group is a difference between the original gray scale data group and a gray scale sum;

wherein the gray scale difference is a difference of the gray scales of the hues between the original gray scale data group and the first gray scale data group, and the gray scale sum is a sum of the gray scales of the hues in the first gray scale data group and the second gray scale data group, wherein the common gray scale is a shared portion of two of the gray scale differences and is equivalent to the relatively smaller one among the gray scale differences that are non-zero.

2. The display driving method according to claim 1, wherein prior to the step of dividing the original gray scale data group into the first gray scale data group, the second gray scale data group, and the third gray scale data group, the method further comprises:

determining an average gray scale in the preset display area according to the original gray scale data group;

acquiring an average hue and a saturation of the preset display area;

upon determining that the second gray scale data group or the third gray scale data group is displayed according to the average hue, the saturation, and the average gray scale, setting the driving light source intensity of a preset hue in the preset display area to be 0.

3. The display driving method according to claim 2, wherein after the step of dividing the original gray scale data group into the first gray scale data group, the second gray scale data group, and the third gray scale data group, the method further comprises:

acquiring an original display duration of the original gray scale data group; and continuously displaying the first gray scale data group, the second gray scale data group, and the third gray scale data group within the original display duration.

4. The display driving method according to claim 2, wherein prior to the step of acquiring the original gray scale data group of each of the pixel units of the content to be displayed and in the preset display area, and prior to acquiring the original light source intensities of each of the hues of the content to be displayed and in the preset display area, the method further comprises:

dividing a display region of an LCD into at least two display areas, and regarding the display areas as the preset display area sequentially.

5. The display driving method according to claim 2, wherein the step of dividing the original gray scale data group into the first gray scale data group, the second gray scale data group, and the third gray scale data group according to the original gray scale data group of each pixel unit comprises:

determining the gray scales of each of the hues in the first gray scale data group according to the minimal gray scale of the original gray scale data group;

determining the gray scales of each of the hues of the second gray scale data group to be the gray scale differences or the common gray scales of the gray scale differences according to the original gray scale data group and the first gray scale data group; wherein the gray scale differences are the differences of the gray scales of the hues between the original gray scale data group and the first gray scale data group; and determining the third gray scale data group according to the original gray scale data group and a gray scale sum; wherein the gray scale sum is the sum of the gray scales of the hues in the first gray scale data group and the second gray scale data group.

6. The display driving method according to claim 1 wherein the step of acquiring the original gray scale data group of each of the pixel units of the content to be displayed and in the preset display area comprises:

acquiring the original light source intensity of each of the hues of a content to be displayed in a preset display area by table look-up.

7. The display driving method according to claim 2, wherein the step of upon determining that the second gray scale data group or the third gray scale data group is displayed according to the average hue, the saturation, and the average gray scale, setting the driving light source intensity of a preset hue in the preset display area to be 0 comprises:

setting the driving light source intensities of blue hues in the preset display area to be 0 in displaying the second gray scale data group, and setting the driving light source intensities of the blue hues and green hues in the preset display area to be 0 in displaying the third gray scale data group, when the average hue of the preset display area satisfies a range from 330° to 30°, and the saturation is in a first custom saturation range, if the hue corresponding to a minimal gray scale in the average gray scales is green, and the hue corresponding to a second minimal gray scale in the average gray scales is green.

8. The display driving method according to claim 2, wherein the step of upon determining that the second gray scale data group or the third gray scale data group is displayed according to the average hue, the saturation, and the average gray scale, setting the driving light source intensity of a preset hue in the preset display area to be 0 comprises:

setting the driving light source intensities of green hues in the preset display area to be 0 in displaying the second gray scale data group, and setting the driving light source intensities of the blue hues and green hues in the preset display area to be 0 in displaying the third gray scale data group, when the average hue of the preset display area satisfies a range from 330° to 30°, and the saturation is in a first custom saturation range, if the hue corresponding to a minimal gray scale in the average gray scales is green, and the hue corresponding to a second minimal gray scale in the average gray scales is green.

9. The display driving method according to claim 2, wherein the step of upon determining that the second gray scale data group or the third gray scale data group is displayed according to the average hue, the saturation, and the average gray scale, setting the driving light source intensity of a preset hue in the preset display area to be 0 comprises:

setting the driving light source intensities of blue hues in the preset display area to be 0 in displaying the second gray scale data group, and setting the driving light source intensities of the blue hues and green hues in the preset display area to be 0 in displaying the third gray scale data group, when the average hue of the preset display area satisfies a range from 30° to 90°, and the saturation is in a second custom saturation range, if the hue corresponding to a minimal gray scale in the average gray scales is green, and the hue corresponding to a second minimal gray scale in the average gray scales is green.

10. The display driving method according to claim 2, wherein the step of upon determining that the second gray scale data group or the third gray scale data group is displayed according to the average hue, the saturation, and the average gray scale, setting the driving light source intensity of a preset hue in the preset display area to be 0 comprises:

setting the driving light source intensities of blue hues in the preset display area to be 0 in displaying the second gray scale data group, and setting the driving light source intensities of the blue hues and red hues in the preset display area to be 0 in displaying the third gray scale data group, when the average hue of the preset display area satisfies a range from 90° to 150°, and the saturation is in a third custom saturation range, if the hue corresponding to a minimal gray scale in the average gray scales is green, and the hue corresponding to a second minimal gray scale in the average gray scales is red.

11. The display driving method according to claim 2, wherein the step of upon determining that the second gray scale data group or the third gray scale data group is displayed according to the average hue, the saturation, and the average gray scale, setting the driving light source intensity of a preset hue in the preset display area to be 0 comprises:

setting the driving light source intensities of blue hues in the preset display area to be 0 in displaying the second gray scale data group, and setting the driving light source intensities of the blue hues and red hues in the preset display area to be 0 in displaying the third gray scale data group, when the average hue of the preset display area satisfies a range from 150° to 210°, and the saturation is in a fourth custom saturation range, if the hue corresponding to a minimal gray scale in the average gray scales is green, and the hue corresponding to a second minimal gray scale in the average gray scales is red.

12. The display driving method according to claim 2, wherein the step of upon determining that the second gray scale data group or the third gray scale data group is displayed according to the average hue, the saturation, and the average gray scale, setting the driving light source intensity of a preset hue in the preset display area to be 0 comprises:

setting the driving light source intensities of red hues in the preset display area to be 0 in displaying the second gray scale data group, and setting the driving light source intensities of the red hues and blue hues in the preset display area to be 0 in displaying the third gray scale data group, when the average hue of the preset display area satisfies a range from 150° to 210°, and the saturation is in a fourth custom saturation range, if the hue corresponding to a minimal gray scale in the average gray scales is red, and the hue corresponding to a second minimal gray scale in the average gray scales is green.

13. The display driving method according to claim 2, wherein the step of upon determining that the second gray scale data group or the third gray scale data group is displayed according to the average hue, the saturation, and the average gray scale, setting the driving light source intensity of a preset hue in the preset display area to be 0 comprises:

setting the driving light source intensities of red hues in the preset display area to be 0 in displaying the second gray scale data group, and setting the driving light source intensities of the blue hues and red hues in the preset display area to be 0 in displaying the third gray scale data group, when the average hue of the preset display area satisfies a range from 210° to 240°, and the saturation is in a fifth custom saturation range, if the hue corresponding to a minimal gray scale in the average gray scales is red, and the hue corresponding to a second minimal gray scale in the average gray scales is green.

14. The display driving method according to claim 2, wherein the step of upon determining that the second gray scale data group or the third gray scale data group is displayed according to the average hue, the saturation, and the average gray scale, setting the driving light source intensity of a preset hue in the preset display area to be 0 comprises:

setting the driving light source intensities of red hues in the preset display area to be 0 in displaying the second gray scale data group, and setting the driving light source intensities of the red hues and green hues in the preset display area to be 0 in displaying the third gray scale data group, when the average hue of the preset display area satisfies a range from 210° to 240°, and the saturation is in a fifth custom saturation range, if the hue corresponding to a minimal gray scale in the average gray scales is red, and the hue corresponding to a second minimal gray scale in the average gray scales is green.

15. The display driving method according to claim 2, wherein the step of upon determining that the second gray scale data group or the third gray scale data group is displayed according to the average hue, the saturation, and the average gray scale, setting the driving light source intensity of a preset hue in the preset display area to be 0 comprises:

setting the driving light source intensities of red hues in the preset display area to be 0 in displaying the second gray scale data group, and setting the driving light source intensities of the red hues and green hues in the preset display area to be 0 in displaying the third gray scale data group, when the average hue of the preset display area satisfies a range from 240° to 300°, and the saturation is in a sixth custom saturation range, if the hue corresponding to a minimal gray scale in the average gray scales is red, and the hue corresponding to a second minimal gray scale in the average gray scales is green.

16. The display driving method according to claim 2, wherein the step of upon determining that the second gray scale data group or the third gray scale data group is displayed according to the average hue, the saturation, and the average gray scale, setting the driving light source intensity of a preset hue in the preset display area to be 0 comprises:

setting the driving light source intensities of green hues in the preset display area to be 0 in displaying the second gray scale data group, and setting the driving light source intensities of the red hues and green hues in the preset display area to be 0 in displaying the third gray scale data group, when the average hue of the preset display area satisfies a range from 240° to 300°, and the saturation is in a sixth custom saturation range, if the hue corresponding to a minimal gray scale in the average gray scales is green, and the hue corresponding to a second minimal gray scale in the average gray scales is red.

17. The display driving method according to claim 2, wherein the step of upon determining that the second gray scale data group or the third gray scale data group is displayed according to the average hue, the saturation, and the average gray scale, setting the driving light source intensity of a preset hue in the preset display area to be 0 comprises:

setting the driving light source intensities of green hues in the preset display area to be 0 in displaying the second gray scale data group, and setting the driving light source intensities of the red hues and green hues in the preset display area to be 0 in displaying the third gray scale data group, when the average hue of the preset display area satisfies a range from 300° to 330°, and the saturation is in a seventh custom saturation range, if the hue corresponding to a minimal gray scale in the average gray scales is green, and the hue corresponding to a second minimal gray scale in the average gray scales is red.

18. The display driving method according to claim 2, wherein the step of upon determining that the second gray scale data group or the third gray scale data group is displayed according to the average hue, the saturation, and the average gray scale, setting the driving light source intensity of a preset hue in the preset display area to be 0 comprises:

setting the driving light source intensities of green hues in the preset display area to be 0 in displaying the second gray scale data group, and setting the driving light source intensities of the blue hues and green hues in the preset display area to be 0 in displaying the third gray scale data group, when the average hue of the preset display area satisfies a range from 300° to 330°, and the saturation is in a seventh custom saturation range, if the hue corresponding to a minimal gray scale in the average gray scales is green, and the hue corresponding to a second minimal gray scale in the average gray scales is green.

19. A display apparatus comprising a memory, a processor and a computer program stored on the memory and executable on the processor, wherein the processor executes the computer program to provide steps comprising:

acquiring an original light source intensity of each of hues of a content to be displayed in a preset display area;

setting a driving light source intensity in the display area to be three times of the original light source intensity;

acquiring an original gray scale data group of each of pixel units of the content to be displayed in the preset display area; and dividing the original gray scale data group into a first gray scale data group, a second gray scale data group, and a third gray scale data group according to the original gray scale data group of each of the pixel units; wherein a gray scale of each of the hues is the minimal gray scale in the first gray scale data group, a gray scale of each of the hues of the second gray scale data group is a gray scale difference or a common gray scale of the gray scale differences, the third gray scale data group is a difference between the original gray scale data group and a gray scale sum;

wherein the gray scale difference is a difference of the gray scales of the hues between the original gray scale data group and the first gray scale data group, and the gray scale sum is a sum of the gray scales of the hues in the first gray scale data group and the second gray scale data group, wherein the common gray scale is a shared portion of two of the gray scale differences and is equivalent to the relatively smaller one among the gray scale differences that are non-zero.

20. A driving method for displaying, comprising:

acquiring an original light source intensity of each hue of a content to be displayed in a preset display area by table look-up;

setting a driving light source intensity in the display area to be three times of the original light source intensity;

acquiring an original gray scale data group of each of pixel units of the content to be displayed in the preset display area;

determining an average gray scale in the preset display area according to the original gray scale data group;

acquiring an average hue and saturation of the preset display area;

upon determining that the second gray scale data group or the third gray scale data group is displayed according to the average hue, the saturation, and the average gray scale, setting the driving light source intensity of a preset hue in the preset display area to be 0; and dividing the original gray scale data group into a first gray scale data group, a second gray scale data group, and a third gray scale data group according to the original gray scale data group of each of the pixel units; wherein a gray scale of each of the hues is the minimal gray scale in the first gray scale data group, a gray scale of each of the hues of the second gray scale data group is a gray scale difference or a common gray scale of the gray scale differences, the third gray scale data group is a difference between the original gray scale data group and a gray scale sum;

wherein the gray scale difference is a difference of the gray scales of the hues between the original gray scale data group and the first gray scale data group, and the gray scale sum is a sum of the gray scales of the hues in the first gray scale data group and the second gray scale data group, wherein the step of upon determining that the second gray scale data group or the third gray scale data group is displayed according to the average hue, the saturation, and the average gray scale, setting the driving light source intensity of a preset hue in the preset display area to be 0 comprises: setting the driving light source intensities of blue hues in the preset display area to be 0 in displaying the second gray scale data group, and setting the driving light source intensities of the blue hues and green hues in the preset display area to be 0 in displaying the third gray scale data group, when the average hue of the preset display area satisfies a range from 330° to 30°, and the saturation is in a first custom saturation range, if the hue corresponding to a minimal gray scale in the average gray scales is green, and the hue corresponding to a second minimal gray scale in the average gray scales is green.

* * * * *